United States Patent [19]

Riba née Hildebrand et al.

[11] 4,259,796

[45] Apr. 7, 1981

[54] PRESS TABLE

[76] Inventors: Jutta Riba née Hildebrand, Rosenbergstr. 26, 5455 Hardert; Hans Rother, Hochstr. 92, 5450 Neuwied 23, both of Fed. Rep. of Germany

[21] Appl. No.: 960,066

[22] Filed: Nov. 13, 1978

[30] Foreign Application Priority Data

Nov. 16, 1977 [DE] Fed. Rep. of Germany ..... 2751283

[51] Int. Cl.[3] ..... D06F 71/34; D06F 81/00

[52] U.S. Cl. ..... 38/15; 38/103

[58] Field of Search ..... 38/2, 3, 14, 15, 16, 38/24, 103, 135, 136

[56] References Cited

U.S. PATENT DOCUMENTS

| | | | |
|---|---|---|---|
| 1,729,353 | 9/1929 | Mitkoff | 38/103 |
| 1,739,571 | 12/1929 | Betke | 38/16 X |
| 2,424,623 | 7/1947 | Monsarrat | 38/15 |
| 2,426,747 | 9/1947 | Reece et al. | 38/15 |
| 2,784,509 | 3/1957 | Ketchum et al. | 38/15 |

*Primary Examiner*—Louis Rimrodt

*Attorney, Agent, or Firm*—Donald Brown

[57] ABSTRACT

A press table comprising a suction and blowing unit is disclosed. The suction and blower unit is adapted for direct connection with the lower side of the press table, thereby achieving optimized changeover speed from suction to blowing and vice versa. The press table comprises one or two auxiliary press table members and control means for automatically bringing the auxiliary press table members into communication with the suction and blower unit when they are used, simultaneously disconnecting the main press table from the unit.

18 Claims, 11 Drawing Figures

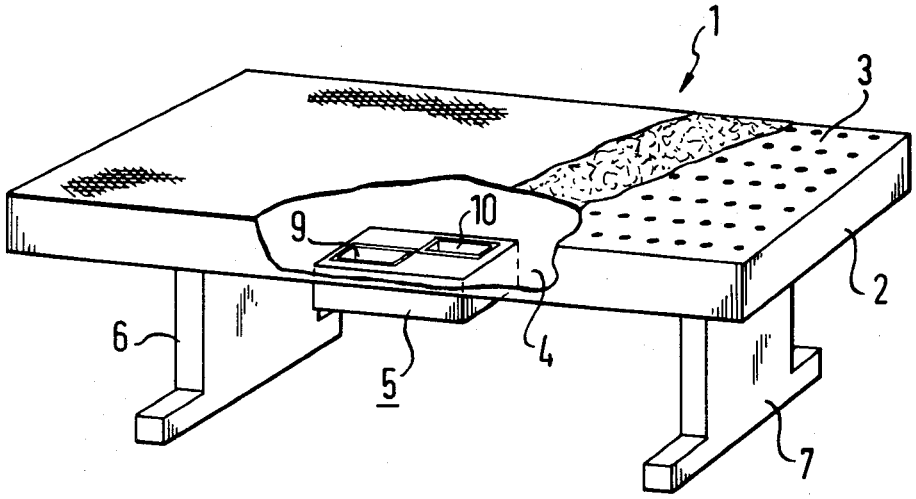

PRESS TABLE

BACKGROUND OF THE INVENTION

This invention relates to a blower and suction unit for press tables, and particularly to an improved blower and suction unit for press tables provided with conduits connecting the suction side of the unit with the lower portion of the press table.

Usual blower and suction units for press tables are mounted to the base frame of a press table. The unit is connected with a vertically adjustable upper portion of the press table through a telescopic pipe. The connection of the upper portion of the press table is through the pipe and the height adjustment is performed in such a way that the telescopic connection is correspondingly more or less extended. These pressing tables are used in connection with steam press irons. The steam is sucked off as quickly as possible through the blower and suction unit to prevent the steam from condensating in the textile fabric thereby wetting the items to be pressed. With certain pressing operations it is of major importance to switch over from suction to blowing within a very short time. For example, when pressing seams, it is usual to change over to blowing after the basic pressing operation in order to remove the marks of the underlying tissue so that the expelled air will drive the overlying tissue to be pressed to a floating state. Subsequently, steam is supplied to the treated portion for a short time so that the mark or impression will disappear. Immediately following this the press table is changed over to suction in order to remove the steam from the fabric.

In a conventional press table the blower and suction unit is mounted to the base frame and connected with the upper portion of the press table through a changeover chamber and a pipe. The level of the upper portion of the press table may be adjusted by the tube being telescopic and the upper portion being secured to one of the pipe portions forming the telescopic connection. For adjusting the height the telescopic connection is more or less extended. The changing over trom blowing to suction and vice versa is made in the changeover chamber mounted at the outlet of the blower and suction unit. Through a mechanic adjusting means the flap in the changeover casing or chamber may be moved into more or less advanced positions to adjust the intensity of suction and blowing. This adjustment is performed upon each changing over operation in accordance with the experience of the operator. Because of the required telescopic connection the blowing and suction unit and the changeover casing are considerably spaced from the pressing surface thereby delaying the effect of changing over from blowing to suction and vice versa. Further, the required piping is responsible for an increased resistance reducing the efficiency of the unit.

OBJECTS OF THE INVENTION

It is a primary object of the invention to provide a blower and suction unit for press tables avoiding the above discussed shortcomings and drawbacks of conventional units.

It is a further object of the invention to provide an improved blower and suction unit for press tables permitting an improved efficiency of the blower.

It is a still further object of the invention to provide an improved blower and suction unit for press tables permitting an improved speed for changing over from suction to blowing and blowing to suction.

A still further object of the invention is to provide an improved blower and suction unit for press tables, which unit is provided with additional means for control of suction from and blowing to a supplemental pressing surface provided in addition to the basic press table.

SUMMARY OF THE INVENTION

These and further objects of the invention are achieved by a blower and suction unit for steam press tables, the unit comprising connecting means for connecting the same with the press table, and further comprising change-over means for changing over the unit from blowing to suction and vice versa, the connecting means being adapted for direct connection of the unit to the lower side of the press table.

BRIEF DESCRIPTION OF THE DRAWINGS

The further objects and features of the invention will be appearant from the following description of several embodiments of the invention in connection with the accompanying drawings.

It should be understood that this invention is in no way limitative and that various changes may be brought thereto without departing from the scope of the invention.

In the drawings:

FIG. 1 shows a partly broken away perspective view of the inventive blower and suction unit;

FIG. 2 shows the unit with two conducts in partly broken away representation;

FIG. 3 shows the device of FIG. 2 in partly broken away representation and in blowing condition;

FIG. 4 shows the device of FIG. 3 in partly broken away representation and in suction condition;

Figure 5:
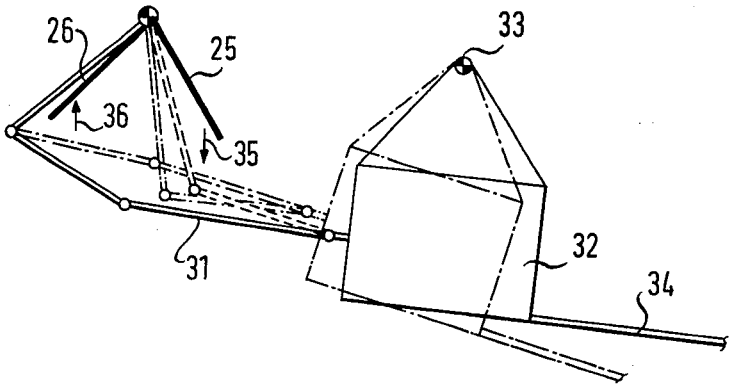
Figure 2:
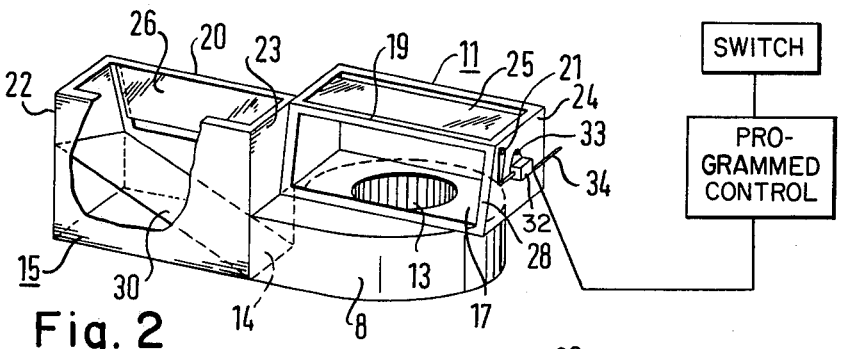
Figure 6:
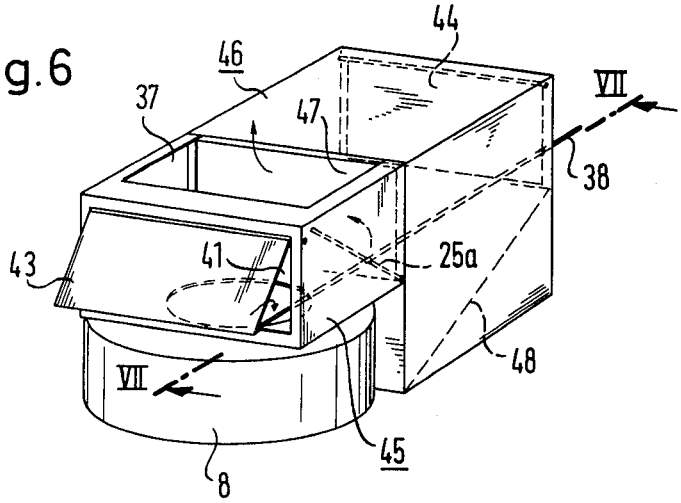
Figure 7:
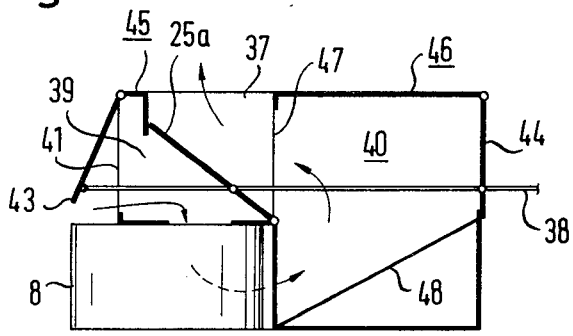
Figure 8:
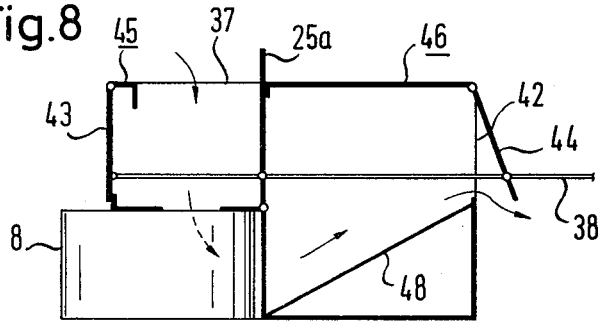
Figure 9:
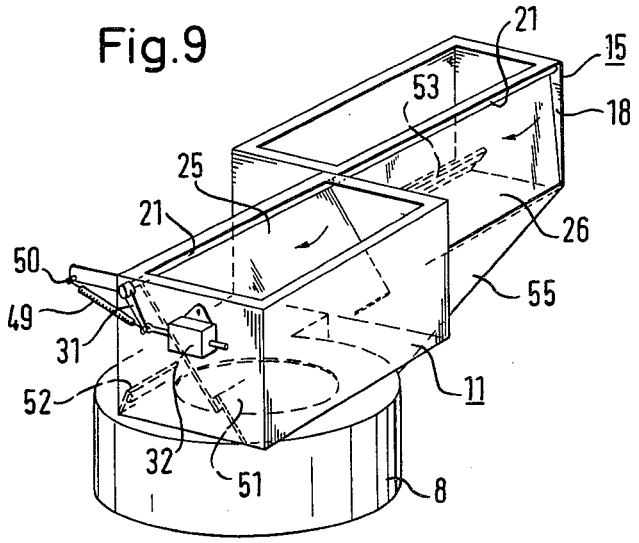
Figure 10:
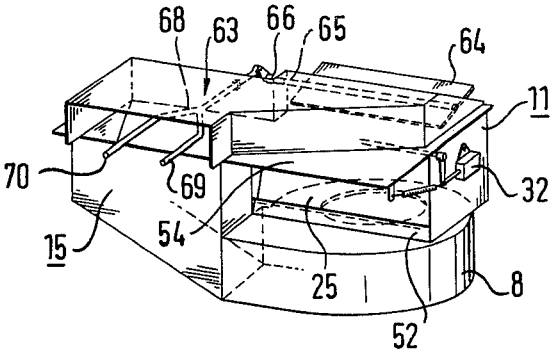

FIG. 5 the pulling solenoid shown in FIG. 2 for rotating a shaft to different end positions;

FIG. 6 shows another embodiment of the invention;

FIG. 7 a sectional view of the embodiment of FIG. 6 along line VII—VII;

FIG. 8 shows the device of FIG. 7 in a second operative position;

FIG. 9 shows a perspective view of another embodiment of the blowing and suction unit intended for use with a supplemental pressing table;

FIG. 10 shows another view of the embodiment of FIG. 9; and

Figure 11:
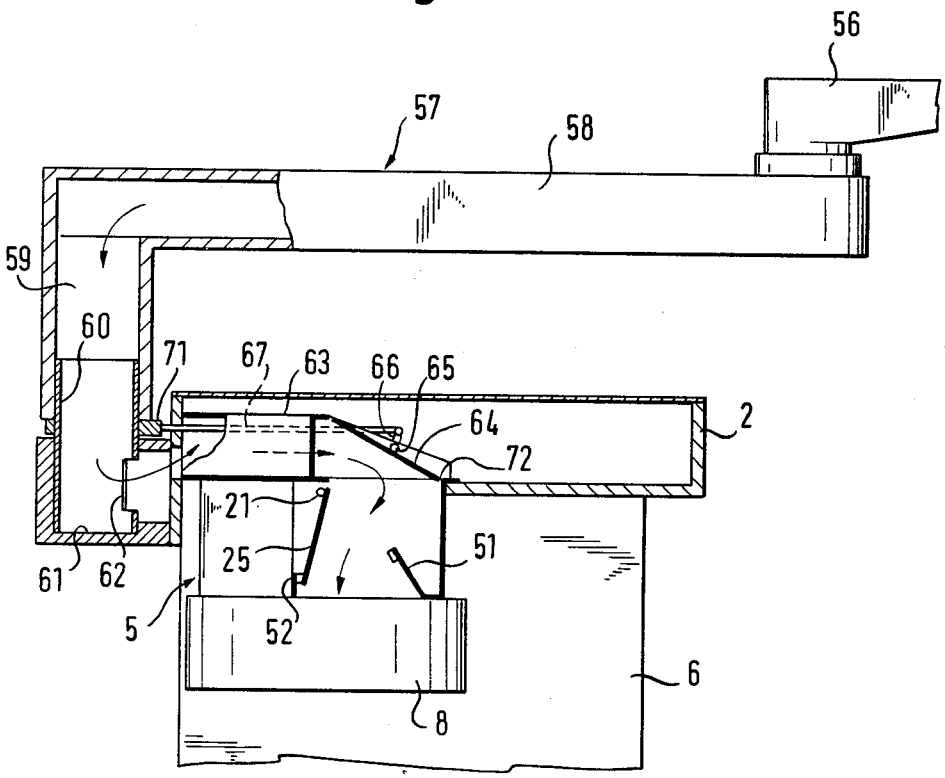

FIG. 11 is a partial sectional view of the embodiment of FIG. 9 and 10 mounted to a press table equipped with a supplemental press table member.

Figure 1:
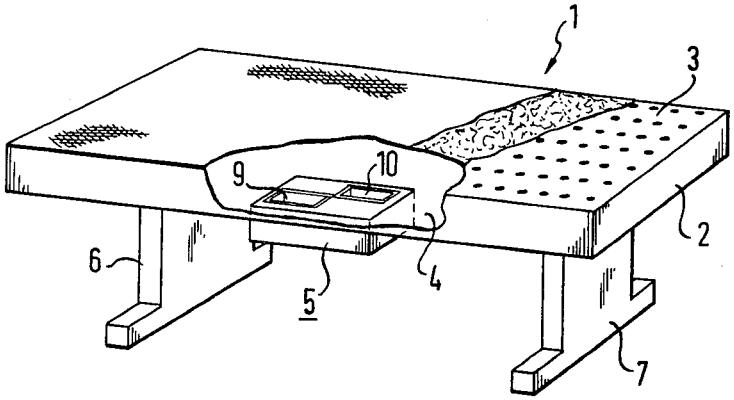

Referring to FIG. 1, a press table 1 having a upper casing 2 is shown. The upper casing 2 is provided with a perforated plate 3 at its upper face which plate is covered with felt and a pressing cloth lying thereover. The blower and suction unit 5 comprising supply ducts is mounted to the lower side 4 of the press table. The mounting is by inserting the unit into an opening provided on the lower side of the table and securing by means of bolts (not shown). The adjustment of the height or level of the press table is performed by adjusting members (not shown) in the legs 6, 7 of the table.

Figure 3:
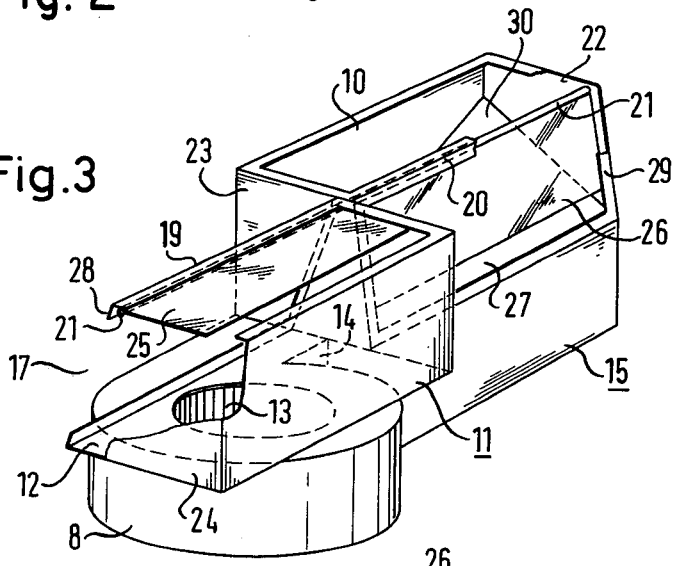
Figure 4:
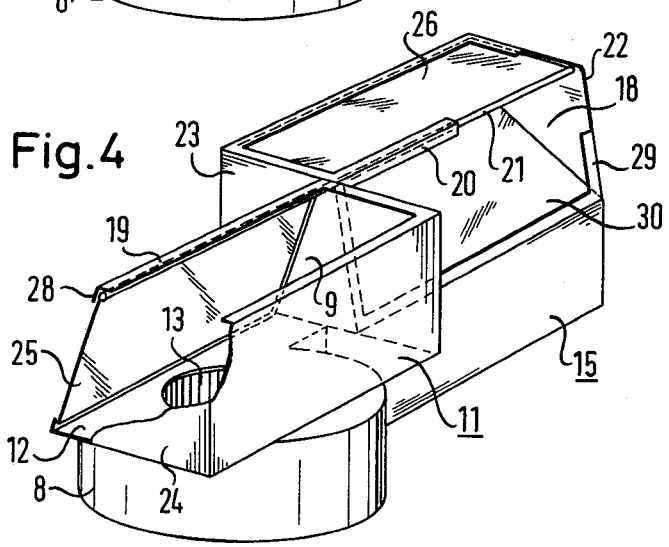

In FIGS. 2–4 the unit is shown as having a blower 8 with a suction inlet channel 9 and a blowing outlet channel 10 of the unit 5.

The inlet channel 9 on the suction side of the blower 8 is formed by a chamber 11 having an opening in its bottom 12 connected with the suction opening 13 of the blower 8. The channel 10 is formed by a chamber 15 connected with the blowing outlet 14 of the blower 8 through an opening in the lower portion of its side wall 23. Both chambers are open at their top sides. The chamber 11 forming the channel on the suction side is open on one longitudinal side, and the chamber 15 forming the channel on the blowing side is open on the opposed transverse side. Both of these openings 17, 18 form the inlet and outlet sides, respectively, of the blower 8 leading towards the environment. Both chambers 11, 15 are laterally shifted with respect to each other as shown in FIGS. 2–4 so that at the inside of the edges 19 defining the channel openings 17, 18 of the first and second chambers, a shaft 21 can extend through both chambers being rotatably supported in lateral walls 22, 23 and 24.

A cover plate 25 is fixed to shaft 21 e.g. by welding, such cover plate being of sufficient dimensions to cover completely opening 17 when being in a downwardly pivoted position, but not completely closing the upper opening leading towards the outlet channel 10 when pivoted to a substantially horizontal position as shown in FIG. 3. A second cover plate 26 is secured to shaft 21 e.g. by welding as shown in FIG. 5, which second cover plate is laterally shifted with respect to plate 25 and also angularly shifted with respect to the latter as shown in FIG. 5. The second cover plate 26 is so dimensioned that in one position it may completely close the upper opening leading towards channel 10 as shown in FIG. 4, however not completely closing opening 18 leading towards the environment in its downwardly pivoted position leaving a free gap 27. The two lateral walls 28 29 provided with the openings 17, 18 leading towards the environment extend in an oblique manner towards the inside so that the channels are upwardly tapered. In the embodiment shown the inclination is of about 15 degrees. The angular displacement of the cover plates 25, 26 from each other is so selected that in the position of FIG. 3 the cover plate 25 is perpendicular to the channel opening leading towards the upper casing and that the cover plate 26 lies in the plane of wall 29. In the second position shown in FIG. 4 the cover plate 25 lies in the plane of the side wall 28 and cover plate 26 is perpendicular to the channel 10 leading towards the upper casing.

For better deflection of the airflow a deflector 30 extending from the bottom side of outlet 14 is arranged in oblique manner in such a way that the airflow is upwardly directed towards opening 18.

In the manner shown in FIGS. 2 and 5 the shaft 21 is connected with a pulling solenoid 32 through a rod system 31. The solenoid 32 is pivotally mounted to the side wall 24 by means of a mounting member 33. The variation of its position is e.g. performed through an outwardly extending adjusting lever 34.

The above disclosed blower and suction unit operates in the following manner: When the blower is switched off and the solenoid is released the cover plates 25, 26 are in the neutral position shown in FIG. 5 due to their own weights, i.e. under gravity, both channel openings directed towards the upper casing as well as both lateral openings towards the environment are open. As soon as the blower is switched on a suctional force acts in the suction channel upon the cover plate 25 in the direction of arrow 35 (FIG. 5) and a pressure force acts on cover plate 26 of the pressure side channel in the direction of arrow 36. Immediately after actuating the blower the basic position shown in FIG. 4 is assumed in which a suction acts through channel 9 and the aspirated air is discharged through opening 18 towards the environment. To change over from the suction position shown in FIG. 4 to the blowing position shown in FIG. 3 the solenoid 32 is operated. Shaft 21 is rotated by the operated solenoid through the rod system from the position shown in FIG. 5 with solid lines into the position shown in dashed lines, i.e. the position in which the cover plates assume the position shown in FIG. 3 in which the pressure side channel is completely open towards the upper casing and the suction side channel is completely closed towards the upper casing.

When it is intended to change over again from blowing to suction the solenoid 32 is released. Due to gravity the cover plates tend to move back towards the neutral position shown in FIG. 5 as soon as the solenoid is no more operative. As will be particularly apparent from FIG. 3 already a minor pivotal movement of the cover plate 26 will bring the same into a position in which the air from the pressure side will no more exert forces on the cover plate. The cover plate 25 will then be further rotated into the neutral position by its own weight, and passing through this position it will finally reach the suction position as disclosed above. In the embodiment shown in FIGS. 2–4 the dimensions are so selected that the cover plates 25 and 26, when in the blowing position, will not completely close the suction channel towards the upper casing and the blowing channel towards the environment. This greatly facilitates the changing over from the blowing position into the suction position because, as will be particularly seen from FIG. 3, the airflow passing through gap 27 will be much increased upon a minor pivotal movement of the cover plate 26 pushing the cover plate towards the inside. Although the airflow is somewhat reduced by the incomplete closure this is without practical importance in view of the suction capacity provided anyway.

Due to the large cross-sectional areas of the conduits formed by the channels the resistance to the airflow is minimized. Changing over is performed very quickly. The changing over back to the suction position being performed without use of an additional spring such element which might be subject to wear is avoided. Another advantage of the device as shown is that upon starting operation of the blower the suctional position is automatically achieved, such suctional position being normally always required in the first place.

With a press table of the above disclosed type various portions are treated one after the other. For each portion of the item to be pressed a specific suctional and blowing action has to be adjusted in function of the material to be treated. In the above shown embodiment this is achieved by the solenoid 32 being pivoted through the adjusting lever 34. It is thereby achieved that the cover plates, when in blowing position, will not completely assume the plane of the openings. Adjustment is performed in accordance with experience of the operator. The advantage of this embodiment lies in the fact that the previously adjusted blowing position will always be automatically achieved upon each new actuation of the blowing position. Thus, a continuous adjustment of the blowing airflow to suit any weight of the items to be pressed may be performed with this embodiment.

When the blower and the solenoid are simultaneously operated the cover plates are immediately moved from the neutral position shown in FIG. 5 to the blowing position shown in FIG. 3. This prevents an undesired suction operation.

FIGS. 6–8 show a second embodiment of the invention. In this embodiment, too, a conduit 39 leading towards the upper casing is connected with the suction side of the blower, such conduit 39 being formed by a chamber 45. The chamber is provided with an opening 37 on its upper side and an opening 41 leading towards the environment on one of its transverse sides. Adjacent this chamber a further chamber 46 is provided which is connected with the outlet side of the blower through its bottom portion. Both adjacent chambers are connected through a wall opening 47. Further, the second chamber is provided with a wall opening on its side opposite the common opening 47.

For closing the various openings a flap 43 pivotally mounted at the top portion of opening 41, a flap 44 pivotally mounted to the upper side of opening 42 and a changing over flap 25*a* mounted to the lower side of opening 47 are provided. These flaps are pivotally connected with an operating rod 38 in the manner shown in FIGS. 7 and 8. Further, the second chamber is provided with a deflector member 48 extending from the bottom of the outlet opening of the blower upwardly towards the lower side of opening 42, the airflow being directed by the deflector member to the upper portion of the chamber.

The above disclosed embodiment operates in the following manner: Through the operating rod 38 the operator adjusts the unit into the blowing position shown in FIGS. 6 and 7. Thus, operating rod 38 is moved into the end position on the left-hand side in FIG. 7 thereby exposing opening 41 and closing opening 42. Further, supply conduct 40 is connected with the upper casing through the common opening 37. When the rod 38 is moved into the end position on the right-hand side in FIG. 8 both openings 41 and 47 are closed and opening 42 is exposed. Further, opening 37 is connected with the suction side of the blower. In this position the blower aspirates the wet steam from the item being pressed. The rod 38 may be adjusted to any intermediate position between both end positions thereby achieving a continuous adjustment.

The second embodiment, too, has the advantage that the blower and the changeover unit may be directly mounted to the upper casing with a constant spacing thereby allowing a very quick changing over from suction to blowing and vice versa. Because of the reduced resistance to airflow the blower operates with optimized suction and blowing efficiency.

The inventive suction and blowing unit is particularly well adapted to be operated in programmed manner. In a further embodiment of the invention intended for programmed operation of the unit a microswitch is provided on the pressing iron. The microswitch 32 is connected through any suitable means with a control unit X which may be programmed in accordance with the requirements of various items to be pressed. The control unit provides output signals for operting the blower 8 and the solenoid 32. For example, for steaming trousers seams the operator actuates the microswitch at the beginning of the pressing operation. After a preselected time from the beginning of the pressing operation the control unit may then operate the suction and blower unit to the suction condition; the control unit may further be programmed to operate the suction and blower unit to intermediate blowing conditions during a suction operation if required by the item to be pressed. Thus, the invention also provides programme-controlled automatic pressing comprising various series of suction and blowing operations.

Although the embodiment shown in FIG. 1–5 is advantageous because of the automatic adjustment of the unit to the suction condition when the solenoid is released it may be preferred in some cases to provide a positive control of the suction and blowing conditions. Thus, referring to FIG. 9, another embodiment is shown which is similar to the embodiments of FIG. 1–5 but in which positive control of both the suction and blowing conditions is provided. In FIG. 9 similar parts are designated by the same reference numerals as in FIG. 1–5. In this embodiment a return spring 49 is provided which may be suitably a coil spring engaging the lever 31 at one of its ends and a mounting pin 50 secured to an extension of the chamber or casing 11 at its other end. Further, in this embodiment flap 25 is so dimensioned that it may completely close the opening leading towards the upper casing. This is because in view of the positive control it is not required to assist movement of flap 25 towards its suction position by the airflow such as through gap 27 in FIG. 3 Similarly, flap 26 is of sufficient dimension to completely close opening 17 when in the appropriate downward position.

Preferably, the return spring 49 is so dimensioned that the forces exerted thereby on the lever 31 will not be sufficient to rotate shaft 21 and flaps 25, 26 secured thereto from their respective positions corresponding to the blowing condition until the blower 8 is shut off and has completely come to rest, which may take about one second or so. In fact, if the final operation performed on the press table is a blowing operation and the whole press table is deactivated thereby switching off the blower 8 and simultaneously releasing solenoid 32, a strong return spring would immediately pull the flaps 25, 26 back to their positions corresponding to a suction condition. As it takes some time for the blower 8 to come to rest, the final blowing operation performed on the press table would be followed by a short undesired suction condition. This may be avoided by appropriately dimensioning return spring 49.

As will be appreciated in FIG. 9, flap 25 is adapted to be pivotally moved between two distinct positions only one of which is shown in FIG. 9. The position shown in FIG. 9 is the blowing position. When in the blowing position flap 25 abuts against a wall member 51 extending within the chamber 11 from the bottom thereof upwardly in inclined manner so as to engage the lower ridge of flap 25 when the same is in the position shown in FIG. 9. A similar wall member 52 extends in chamber 11 from the bottom upwardly in inclined manner being spaced from a wall member 51. The upper ridge of wall member 52 extends to a level sufficient to engage the lower ridge of flap 25 when the same is pivoted by the return spring 49 into the suction position.

While in the embodiment of FIG. 1–5 the pivotal movement of both flaps 26, 25 is of about 90 degrees or more, in the embodiment shown in FIG. 9, the pivotal movement of flap 25 is only of about 45 degrees or so. As flap 26 is rigidly secured to shaft 21, this flap 26 will also perform a pivotal movement of about 45 degrees. In the blowing condition shown in FIG. 9, the flap 26 is in a downwardly extending position completely closing opening 18 leading to the environment. However, in the suction position, flap 26 is pivoted into a position in which its lower edge will abut against a wall member 53 similar to wall members 51 and 52, but extending within chamber 15.

In operation of the embodiment of FIG. 9, when the suction and blower unit is in the blowing position shown in FIG. 9, air is sucked in by the blower 8 through the opening defined by wall member 52, the lateral walls of chamber or casing 11 and an upper extension 54 of casing 11. At the output side of the blower 8 the air is expelled and discharged through an inclined channel 55 connecting the discharge side of the blower 8 with chamber 15. From chamber 15 the air will escape upwardly through the open top of the chamber.

The suction condition of the embodiment of FIG. 9 will be disclosed with reference to FIG. 10 in which a similar embodiment is shown in the suction condition, this embodiment being further provided with additional means (later disclosed) for connecting the suction and blower unit with an additional or auxiliary press table portion.

In the suction condition shown in FIG. 10, the flap 25 engages wall portion 52, and flap 26 engages wall portion 53. Thus, in operation, the air sucked in by the blower 8 will flow through the open top of chamber 11 and the passage defined by flap 25, wall member 51 and the lateral sides of chamber 11. At the pressure side of blower 8 the air will be pushed through channel 55 and escape from the exposed opening 18 leading towards the environment.

In the embodiment shown in FIGS. 10 and 11 the suction and blower unit of FIG. 9 is combined with additional means for connecting the unit to and disconnecting the unit from an auxiliary or additional press table member 56 supported by a hollow structure 57 pivotally mounted on the press table. The pivotal supporting structure 57 comprises a horizontal tube member 58 and a vertical tube member 59 connected to the horizontal tube member 58. A short tube section 60 is fitted to the lower end of tube member 59, tube section 60 being rotatably inserted into a hollow chamber 61 provided on the backside of the press table. At its lower end tube section 60 is provided with an opening extending only over part of its periphery. This opening 62 is formed by cutting away part of tube section 60. Through the opening 62 the auxiliary press table 56 may be brought into communication with the suction and blower unit through tube members 58 and 59 and further through a casing 63 mounted on top of the unit shown in FIG. 9. However, when the auxiliary press table is not used, it is pivoted into a position substantially at right angles to the position shown in FIG. 11, thereby pivoting tube member 59 and tube section 60 to a position in which the opening 62 is no longer in registry with a corresponding opening of the casing 62. Thus, in the pivoted position, the auxiliary press table 56 will be disconnected from the suction and blower unit.

The embodiment shown in FIG. 10 and 11 is further provided with an additional flap 64 intended for disconnecting the main press table from the unit 5 when the auxiliary press table 56 is used. Flap 64 is rigidly secured to a shaft 65 mounted for pivotal movement in the lateral walls of casing 63. An actuating lever 66 is rigidly secured to one end of shaft 65. At its other end lever 66 is pivotally connected to one end portion of a control rod 67 the other end of which is connected to a fork-type bracket 68. The two legs 69, 70 of bracket 68 are provided the end portions acting as cam followers and being in sliding engagement with respective cams 71 secured to the lower end of the vertical tube member 59. Thus, when in the position shown in FIG. 11, cam 71 will push the control rod 67 towards the right-hand side in FIG. 11, thereby pivoting flap 64 into a position in which the flap 64 completely closes an opening 72 in the top portion of casing 63, thereby completely disconnecting the upper casing 2 of the main press table from the unit 5. This applies to the suction as well as to the blowing condition. However, when in inoperative, pivoted position of the auxiliary press table 56, the opening 62 is closed, thereby disconnecting the auxiliary press table 56 from the unit 5, and the flap 64 will be controlled into a position (not shown) in which the opening 72 is exposed. Thus, in the latter position, the main press table will be in connection with unit 5. Control of flap 64 back into its position, in which the main press table 1 is operative, may be by any conventional means such as a further return spring (not shown). Of course, cam 71 is conveniently shaped to allow movement of control rod 67 towards the left-hand side in FIG. 11 when tube member 59 is pivoted.

Thus, with the embodiment shown in FIG. 11, the suction and blower unit 5 may be selectively brought into communication with either main press table 1 or one or two auxiliary press tables 56. To activate an auxiliary press table 56 and deactivate main table 1 it is sufficient to merely pivot the required auxiliary press table to the operative position shown in FIG. 11. It should be appreciated that only one leg 69 or 70 of the fork-type bracket 68 will be in engagement with one cam 71, the respective other leg being in engagement with the cam 71 of a similar tube member 59 arranged adjacent and parallel to the one shown in FIG. 11 and intended for supporting another auxiliary press table 56.

It should be understood that the present invention is in no way limited to the embodiments disclosed and that many modifications may be brought thereto without departing from the scope of the invention.

What is claimed is:

1. A blower and suction unit for steam press tables comprising connecting means for connecting said unit with said press table, said press table having an upper pressing surface and a lower surface spaced from said upper pressing surface and comprising a hollow casing connected with a suction chamber which is further connected with the suction side of a blower comprised in said unit, said casing being further connected with a blowing chamber which is further connected with the pressure side of said blower, and wherein the suction chamber and blower chamber are connected to the hollow chamber through a common opening, change-over means for changing over said unit from blowing to suction and vice-versa and means to at least substantially prevent communication between either said hollow casing and said suction side or between said hollow casing and said pressure side of said blower.

2. The unit of claim 1, wherein each of said chambers is provided with a closure member and control means are provided for operating both closure members in a fixed relation with respect to each other.

3. The unit of claim 2, wherein both closure members are adapted to assume an intermediate position when said blower is inoperative, in which intermediate position both said pressure side and said suction side of said blower are in communication with both said hollow casing and the surrounding environment.

4. The unit of claim 3, wherein said closure member of said blowing chamber, when in said intermediate position, is adapted to be operated into its closure position by an airflow generated by said blower upon reactivation thereof.

5. The unit of claim 2, wherein in the blowing condition of said unit, said closure member of said suction chamber does not completely isolate said hollow chamber from said suction side of said blower.

6. The unit of claim 2, wherein in the blowing condition of said unit, said closure member of said blowing chamber does not completely close said blowing chamber from the surrounding environment.

7. The unit of claim 2, wherein both closure members are mounted on a common operating shaft.

8. The unit of claim 2, wherein both of said closure members are adapted to be moved between a first position in which the respectively associated chamber is in communication with said hollow casing and a second position in which said associated chamber is in communication with the surrounding environment.

9. The unit of claim 2, wherein said control means comprises electrically operated means for moving said closure members into a position in which said hollow casing is in communication with said suction side of said blower.

10. The unit of claim 9, wherein said control means comprises a solenoid with adjustable end positions.

11. The unit of claim 2, wherein said control means comprises a rod system for adjustably operating said closure members into intermediate positions.

12. The unit of claim 1, wherein said unit comprises a blower arranged at a predetermined constant distance from said upper pressing surface.

13. The unit of claim 1, wherein programmable control means are provided for programmed control of said changing over of said unit from said blowing in said suction condition and vice versa.

14. A steam press table comprising a blower and suction unit for selectively providing a suction effect or a blowing effect to said press table, a hollow casing having an upper pressing surface and a lower surface spaced from said pressing surface and at least one auxiliary press table member, wherein control means are provided for selectively bringing said blower and suction unit into communication with either said hollow chamber or said auxiliary press table member comprising movable flap means operated by connecting means connecting said auxiliary press table member with said press table, said auxiliary press table member and said connecting means being movable with respect to said press table.

15. A steam press table comprising a blower and suction unit for selectively providing a suction effect or a blowing effect to said press table, a hollow casing having an upper pressing surface and a lower surface spaced from said pressing surface and at least one auxiliary press table member, said suction and blowing unit being substantially mounted within said hollow casing, and control means for selectively bringing said blower and suction unit into communication with either said hollow chamber or said auxiliary press table member.

16. A blower and suction unit for steam press tables, having an upper hollow press table unit and a lower hollow press table unit spaced from said upper hollow press table unit; changeover means for changing over said blower and suction unit from blowing to suction and vice-versa, said means including a housing incorporating said changeover means, said housing having a suction opening and a discharge opening, said suction and discharge openings being in immediate communication with corresponding openings provided in at least one of said press table units, said at least one press table unit comprising a hollow casing directly connected with a suction chamber which is further connected with the suction side of the blower, comprised in said blower and suction unit, and said casing being further directly connected through said discharge opening with a blower chamber which is further connected with a pressure side of said blower; and means to at least substantially prevent communication between either said hollow casing and said suction side or between said hollow casing and said pressure side of said blower.

17. A blower and suction unit for steam press tables having an upper hollow press table unit and a lower hollow press table unit spaced from said upper hollow press table unit, and wherein at least one press table unit comprises a hollow casing connected with a suction chamber which is further connected with the suction side of the blower, comprised in said blower and suction unit, said casing being further connected through said discharge opening with a blower chamber which is further connected with the pressure side of said blower, and changeover means for changing over said blower and suction unit from blowing to suction and vice-versa, said means includng a housing incorporating said changeover means, said housing having a suction opening and a discharge opening, said suction and discharge openings being in immediate communication with corresponding openings provided in at least one of said pressure table units and means to at least substantially prevent communication between either said hollow casing and said suction side or between said hollow casing and said pressure side of said blower.

18. A press table according to claim 17, wherein the connections between the hollow casing and the suction chamber and between the hollow casing the blower chamber increase in cross-sectional area from said chambers towards said hollow casing.

* * * * *